US010060085B2

(12) United States Patent
Christian

(10) Patent No.: US 10,060,085 B2
(45) Date of Patent: Aug. 28, 2018

(54) SPRAY ASSEMBLY FOR A WORKING MACHINE EMPLOYING DIRECT ACTING VALVES

(71) Applicant: Roadtec, Inc., Chattanooga, TN (US)

(72) Inventor: Richard Christian, Chattanooga, TN (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 15/496,714

(22) Filed: Apr. 25, 2017

(65) Prior Publication Data

US 2017/0314214 A1 Nov. 2, 2017

Related U.S. Application Data

(60) Provisional application No. 62/330,643, filed on May 2, 2016.

(51) Int. Cl.

| | |
|---|---|
| ***E01C 19/48*** | (2006.01) |
| ***E01C 19/17*** | (2006.01) |
| ***B05B 13/00*** | (2006.01) |
| ***B05B 1/30*** | (2006.01) |
| ***B05B 9/04*** | (2006.01) |
| ***B05B 12/00*** | (2018.01) |
| *E02D 3/12* | (2006.01) |

(52) U.S. Cl.

CPC ..... *E01C 19/176* (2013.01); *B05B 1/3013* (2013.01); *B05B 9/0423* (2013.01); *B05B 12/008* (2013.01); *B05B 13/005* (2013.01); *E01C 19/48* (2013.01); *E02D 3/12* (2013.01)

(58) Field of Classification Search

CPC ..... E01C 19/176; E01C 19/48; B05B 1/3013; B05B 9/0423; B05B 12/008; B05B 13/005; F16K 31/0675

USPC ..... 239/11

See application file for complete search history.

(56) References Cited

U.S. PATENT DOCUMENTS

| | | | | |
|---|---|---|---|---|
| 4,220,998 A | | 9/1980 | Kays | |
| 4,530,463 A | * | 7/1985 | Hiniker | B05B 9/06 239/155 |
| 4,530,465 A | * | 7/1985 | Gauchet | A01M 7/0089 239/127 |
| 4,553,702 A | * | 11/1985 | Coffee | A01M 7/0092 222/23 |
| 4,559,831 A | * | 12/1985 | Prestele | A61M 5/16886 73/861.05 |

(Continued)

OTHER PUBLICATIONS

International Search Report and Written Opinion of Counterpart PCT Application No. PCT/US2017/029383 filed Apr. 25, 2017.

*Primary Examiner* — Chee-Chong Lee

(74) *Attorney, Agent, or Firm* — Chambliss, Bahner & Stophel, P.C.

(57) ABSTRACT

A spray assembly for a working machine that includes a fluid storage tank includes a plurality of nozzle assemblies, each of which includes a direct acting valve. The spray assembly also includes a controller that is operatively connected to each of the direct acting valves for controlling the opening and closing of the direct acting valves, and a selector that is operatively connected to the controller. The selector may be employed by an operator of the working machine to selectively operate one or more of the direct acting valves in order to provide a desired spray pattern of fluid from the fluid storage tank.

8 Claims, 4 Drawing Sheets

(56) References Cited

U.S. PATENT DOCUMENTS

| | | | | | |
|---|---|---|---|---|---|
| 4,777,832 | A | * | 10/1988 | Prodosmo | G01F 23/241 222/64 |
| 4,821,769 | A | * | 4/1989 | Mills | F16K 37/0041 137/554 |
| 4,932,232 | A | * | 6/1990 | Ballyns | B05B 12/04 72/201 |
| 4,986,782 | A | | 1/1991 | Severtson | |
| 5,020,725 | A | | 6/1991 | Waldrum | |
| 8,649,150 | B2 | | 2/2014 | Buxton | |
| 2014/0120251 | A1 | | 5/2014 | Grimm et al. | |

* cited by examiner

SPRAY ASSEMBLY FOR A WORKING MACHINE EMPLOYING DIRECT ACTING VALVES

CROSS-REFERENCE TO RELATED APPLICATION

This application claims the benefit of U.S. Provisional Patent Application No. 62/330,643 which was filed on May 2, 2016.

FIELD OF THE INVENTION

This invention relates to a spray assembly for a working machine such as a milling machine, a reclaimer/soil stabilizer machine, a tack distributor truck, or an asphalt paving machine. More specifically, the invention relates to a valve assembly for spraying water at a high flow rate or for spraying dense fluids such as asphalt cement and asphalt emulsions.

BACKGROUND AND DESCRIPTION OF THE PRIOR ART

Roadwork is typically carried out by working machines that carry one or more working components and travel along a roadway. One such working machine is a milling machine, a wheeled or track-driven vehicle that is provided with a rotating working drum that includes a plurality of cutting teeth. The drum is mounted in a housing on the frame of the machine and adapted to be lowered into contact with the road surface and rotated about a horizontal axis so as to cut into the surface to a desired depth as the machine is advanced along the roadway. Generally, the milling machine also includes a conveyor system that is designed to carry the milled material which has been cut from the roadway by the rotating drum to a location in front of, to the rear of, or beside the machine for deposit into a truck for removal from the milling site. One or more spray assemblies are typically mounted over the conveyors and inside the drum housing so that water may be sprayed to control the dust and heat that is generated in the milling process. Generally, it is necessary to provide a water spray at relatively high flow rates in order to control the heat and dust generated during a milling operation. If the machine is used for cold in-place recycling, a second spray assembly may be provided to spray an asphalt emulsion or liquid asphalt cement onto the milled material. Steerable track or wheel drive assemblies are provided to drive the machine and to steer it along a desired milling path. Power for driving the machine and for operating its systems is typically provided by a diesel engine.

Another type of working machine is a road stabilizer/reclaimer machine. This machine is similar to a milling machine in that it comprises a wheeled or track-driven vehicle that includes a milling assembly comprising a milling drum with a plurality of cutter teeth mounted thereon which is contained within a milling enclosure or chamber. However, the milling drum of a road stabilizer/reclaimer machine is generally employed to mill or pulverize an existing road bed or roadway to a greater depth than does a milling machine prior to repaving (usually called reclaiming) or prior to initial paving (usually called stabilizing), and it leaves the pulverized material in place. A water spray assembly, similar to that provided in a milling machine, is provided to control the dust and heat that is generated in the milling or pulverizing process. If the machine is used for cold in-place recycling, a second spray assembly may be provided to spray an asphalt emulsion or liquid asphalt cement onto the pulverized material.

When a milling or stabilizing operation has been completed, paving of the roadway with asphalt paving material is generally carried out by another working machine. An asphalt paving machine is supplied with asphalt paving material by a number of supply trucks and/or a material transfer vehicle. The paving machine is self-propelled and driven by a wheeled or track drive system. In a common type of paving machine, an asphalt receiving hopper is located at the front end of the machine to receive asphalt paving material from a truck or material transfer vehicle, and a hopper conveyor located below the asphalt receiving hopper transfers the asphalt paving material from the hopper to an asphalt distributing assembly comprising a transverse distributing auger that is mounted near the rear of the machine. The asphalt paving material is deposited onto and across the roadway or other surface to be paved by the distributing auger, and a floating screed located at the rear end of the machine behind the distributing auger compacts the asphalt paving material to form an asphalt mat.

It is frequently desirable to apply an asphalt emulsion, liquid asphalt cement or a similar substance (commonly referred to as "tack" or "tack material") onto the surface of the roadway prior to distributing and compacting the asphalt paving material into a mat to assist in binding the asphalt paving material to the underlying surface. Tack is typically applied just prior to a paving operation by being sprayed onto the surface to be paved from a spray bar or spray assembly that extends transversely across the surface. Some asphalt paving machines include a tack spray assembly that is adapted to deposit tack material onto the surface of the roadway ahead of the distributing auger. Sometimes the tack material is applied by another working machine, a tack distributor truck that travels ahead of the asphalt paving machine.

The various spray assemblies that are found on milling machines, stabilizer/reclaimer machines, asphalt paving machines and tack distributor trucks typically include a plurality of spray nozzles, each of which is actuated by a poppet valve. Direct fluid actuation of the valves associated with the spray assemblies has not been considered to be practical, because the flow rates for water sprays through the valve assemblies in working machines are too high to reliably open and close the valves, and the hot asphalt cements and emulsions used in asphalt paving materials or tack sprays are so viscous that they will "freeze" in the valve assemblies. Consequently, these spray assemblies generally employ smaller pilot-controlled valves that use an intermediate power transmission fluid such as air or hydraulic fluid to control the opening and closing of the spray valves. Such a valve assembly is generally quite reliable, but it requires a separate fluid circuit for the pilot fluid, and multiple fluid lines between the small control valves and the poppet valve assemblies. It would be desirable if a spray assembly for a working machine could be provided that could employ a simpler but reliable control system.

Advantages of Preferred Embodiments of the Invention

Among the advantages of this invention is that it provides a system for direct actuation of the valves associated with the nozzles of a spray assembly that is employed on a working machine such as a milling machine, a reclaimer/soil stabilizer machine, an asphalt paving machine or a tack distributor truck. Such direct acting valves do not need separate fluid control circuits, thereby eliminating the need for smaller fluid actuated pilot valves and the components and fluid piping associated with air or hydraulic fluid circuits. Consequently, such direct acting valves may be located more advantageously than pilot fluid control valves so as to minimize the space required for the valve assemblies.

Additional objects and advantages of this invention will become apparent from an examination of the drawings and the ensuing description.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "connected" and "interconnected", refer to a relationship wherein structures or components are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures or components to operate as intended by virtue of that relationship. The term "electrically connected" is such an attachment, coupling or connection that allows for the flow of electricity from one such structure or component to or by means of the other. The term "fluid communication" is such an attachment, coupling or connection that allows for flow of fluid from one such structure or component to or by means of the other.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "aggregate materials" and similar terms refer to crushed stone and other particulate materials that are used in the production of asphalt paving materials, such as, for example, crushed limestone and other types of crushed stone, crushed Portland cement concrete, shredded or comminuted mineral and cellulosic fibers, recycled asphalt pavement, recycled asphalt shingles, gravel, sand, lime and other particulate additives.

The term "asphalt cement" and similar terms refer to a bituminous fluid that is used in combination with aggregate materials in the production of asphalt paving materials, or as a tack material. Asphalt cement acts as the binder for various aggregate materials in the production of asphalt paving materials. The term "asphalt emulsion" refers to a chemically stabilized dispersion of asphalt cement in water. Asphalt emulsions are also used in combination with aggregate materials in the production of asphalt paving materials, or as tack materials.

The term "asphalt paving materials" and similar terms refer to a bituminous paving mixture that is produced, using asphalt cement or an asphalt emulsion and any of various aggregate materials in an asphalt production plant.

The terms "above", "upper" and similar terms, when used with respect to a spray assembly of a working machine or a component of such a spray assembly, refer to a relative location or direction away from the surface on which the machine is operated.

The terms "below", "lower" and similar terms, when used with respect to a spray assembly of a working machine or a component of such a spray assembly, refer to a relative location or direction towards the surface on which the machine is being operated.

The term "working direction" refers to the primary direction of travel of a working machine as it operates in working on a roadway or road bed.

The term "frame" means the structural part of a working machine that supports a spray assembly.

The term "linear actuator" refers to an electric, hydraulic, electro-hydraulic, pneumatic or mechanical device that generates force which is directed in a straight line. A "linear solenoid" is a type of linear actuator that comprises an electrical coil wound around a cylindrical tube that contains a ferromagnetic actuator or plunger which is free to move axially along the tube. A return spring is generally provided at one end of the cylindrical tube or adjacent to a component that moves with the plunger. When an electrical current is passed through the coil, a magnetic field is established which attracts the plunger towards the center of the coil, causing it to move within the tube until it compresses the return spring. When the flow of electrical current stops, the return spring forces the plunger back out to its original rest position.

The term "direct acting valve" refers to a valve that does not require a separate fluid control circuit.

SUMMARY OF THE INVENTION

The invention comprises a spray assembly that is mounted to the frame of a working machine and includes a plurality of spray nozzles. Associated with each spray nozzle in the spray assembly is a direct acting valve, more particularly a direct acting poppet valve that is enabled by a linear solenoid. The invention also includes a power source for selectively energizing the linear solenoids, a controller for controlling the actuation of the linear solenoids and a selector that may be employed by an operator of the working machine to select one or more of the direct acting poppet valves for operation.

In a preferred embodiment of the invention, the controller is adapted to employ pulse-width modulation ("PWM") current control to reduce the current required to hold the direct acting poppet valves open, also known as "holding current". In another embodiment of the invention, the poppet valve could be provided with a mechanical lock that would hold the valve open, so that the valve could be closed with a solenoid low current release.

In order to facilitate an understanding of the invention, a preferred embodiment of the invention, as well as the best mode known by the inventor for carrying out the invention, is illustrated in the drawings, and a detailed description thereof follows. It is not intended, however, that the invention be limited to the particular embodiment described or to use in connection with the apparatus illustrated herein. Therefore, the scope of the invention contemplated by the inventor includes all equivalents of the subject matter recited in the claims, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 1:
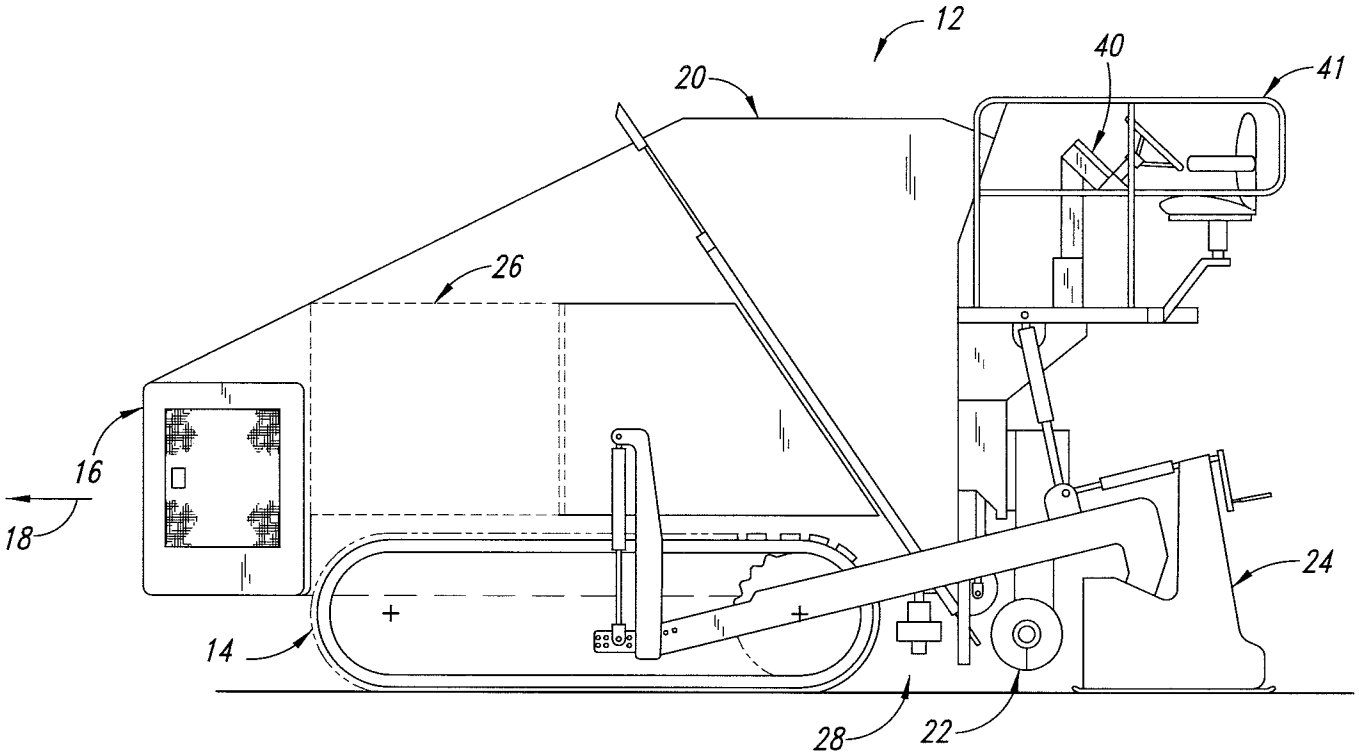
FIG. 1 is a side view of an asphalt paving machine to which a first embodiment of the invention has been applied.

The invention comprises a spray assembly for use in connection with a working machine such as asphalt paving machine 12 shown in FIG. 1. As shown therein, paving machine 12 includes a track drive system 14 that is driven by an engine (not shown, but housed in engine compartment 16) so as to move in the working (or paving) direction indicated by arrow 18. Paving machine 12 also includes gravity-fed hopper 20 that is adapted to receive a quantity of asphalt paving material from a delivery truck or material transfer vehicle (not shown). A conventional conveyor (also not shown) is mounted in the bottom of hopper 20 and adapted to convey asphalt paving material from hopper 20 to transverse distributing auger 22 which operates to distribute the asphalt paving material across the width of the roadway or portion thereof to be paved. Floating screed 24 is located behind the distributing auger and adapted to level and compact the asphalt paving material to form an asphalt mat. Asphalt paving machine 12 also includes fluid storage tank 26 for tack material, which fluid storage tank is in fluid communication with spray assembly 28. As would be appreciated by those having ordinary skill in the art to which the invention relates, this fluid communication comprises a fluid circuit between fluid storage tank 26 and spray assembly 28 which includes a pump and suitable piping or hoses to convey the tack material from the storage tank to the spray assembly.

Figure 2:
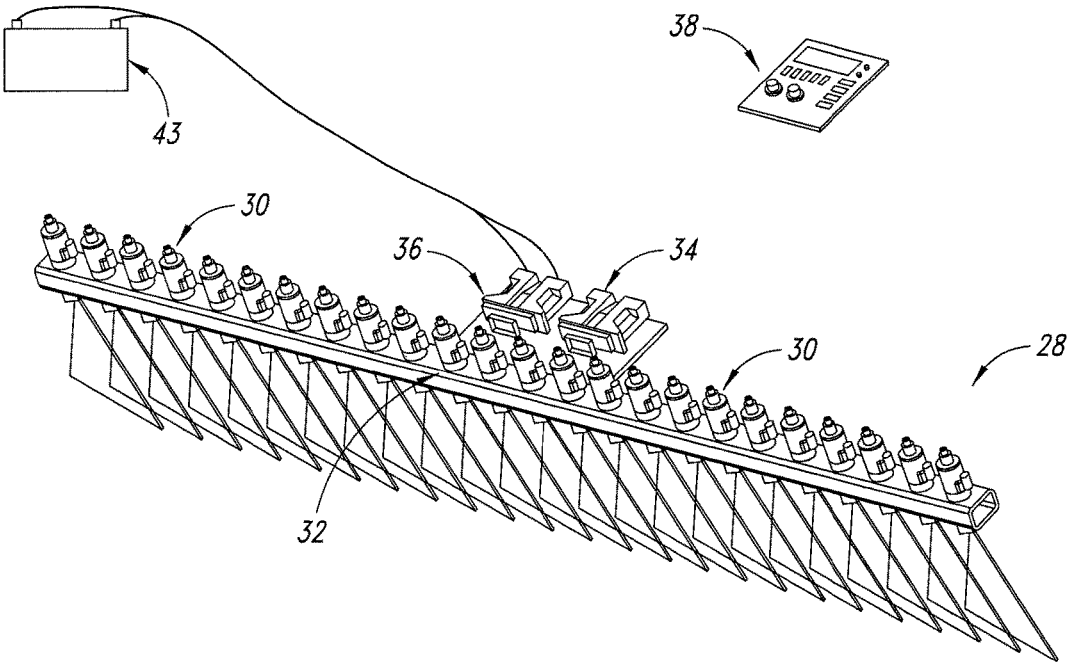
FIG. 2 is a perspective view of a first embodiment of the spray assembly shown in FIG. 1.

Referring now to FIG. 2, spray assembly 28 is attached to the frame of machine 12 and includes twenty-four nozzle assemblies 30 that are mounted onto support beam 32. Also included in the invention is a controller comprised of input module 34, output module 36, and spray control 38. Input module 34 and output module 36 may be located near spray assembly 28 and operatively connected to spray control 38 which is located in operator's control panel 40 in operator's station 41 (see FIG. 1). Input module 34 is operatively connected to solenoid switch assembly 42 of each nozzle assembly 30 of spray assembly 28 and to spray control 38, and is adapted to determine if the valve assembly associated with each nozzle assembly 30 is open or closed and to communicate this information to an operator of machine 12. In a preferred embodiment of the invention, input module 34 is also operatively connected to various sensors (not shown) in the spray assembly, such as sensors that measure fluid temperature, pressure, flow rate and other operating parameters in the system, and to spray control 38. In this preferred embodiment, input module 34 is adapted to provide information about these system parameters to a machine operator located in operator's station 41. Output module 36 is operatively connected to a power source such as battery 43, and is adapted to energize the various solenoid switch assemblies in spray assembly 28. Output module 36 is also operatively connected to spray control 38 to allow an operator of machine 12 to control the activation of the various solenoid switch assemblies in spray assembly 28.

Figure 3:
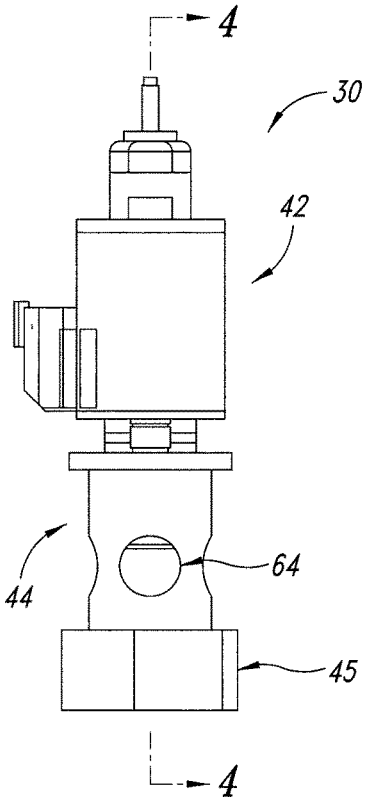
FIG. 3 is a side view of a direct acting poppet valve assembly that is employed in connection with the invention.
Figure 4:
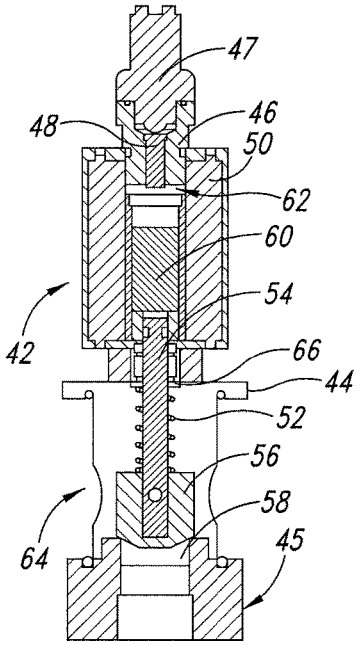
FIG. 4 is a sectional view of the direct acting poppet valve assembly of FIG. 3, taken through the line 4-4 of FIG. 3, which shows the valve assembly in a closed position.

Nozzle assembly 30 is shown in more detail in FIGS. 3 and 4. As shown therein, nozzle assembly 30 comprises a direct acting valve which includes solenoid switch assembly 42 and a valve assembly comprising valve housing 44 and nozzle housing 45. As best shown in FIG. 4, this direct acting valve comprises a direct acting poppet valve that is enabled by a linear solenoid. Solenoid switch assembly 42 includes switch pin insulator 46 which is operatively attached to switch conductor 47. Switch conductor 47 is electrically connected to power source 43, and switch pin 48 is electrically connected to switch conductor 47 to provide a path for electricity from power source 43 to coil 50. As shown in FIG. 4, the solenoid switch assembly is not energized, so that return spring 52 surrounding poppet shaft 54 holds poppet 56, which is attached to the lower end of the poppet shaft, in abutment with poppet bushing 58 in nozzle housing 45, thereby closing the valve. When the controller causes electricity to flow from power source 43 through switch conductor 47 and switch pin 48 to energize coil 50, plunger 60, which is attached to the upper end of poppet shaft 54, is drawn upwardly by the magnetic field generated by the coil until its upper end abuts travel stop 62. This causes poppet 56 to withdraw from poppet bushing 58, thus allowing asphalt emulsion or another fluid to enter valve housing 44 through inlet ports 64 under pressure sufficient to discharge it out the bottom of nozzle housing 45. Shaft seal 66 prevents fluid from leaking upwardly around poppet shaft 54.

Figure 5:
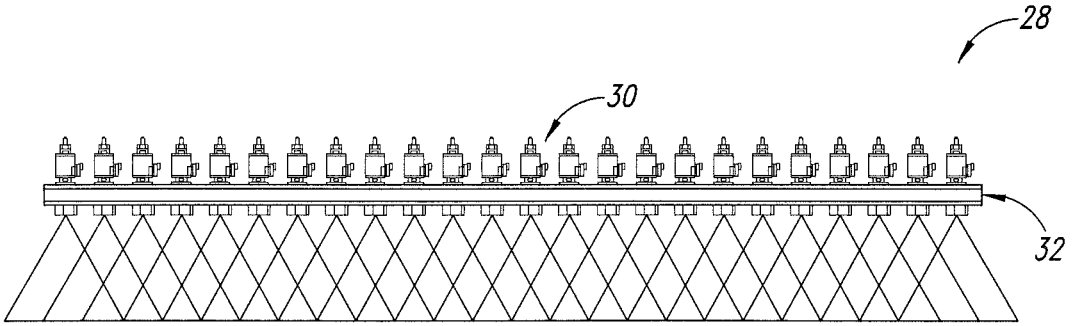
FIG. 5 is a front view of the first embodiment of a spray assembly of the invention that is illustrated in FIG. 2, showing its use in applying a first spray pattern.
Figure 6:
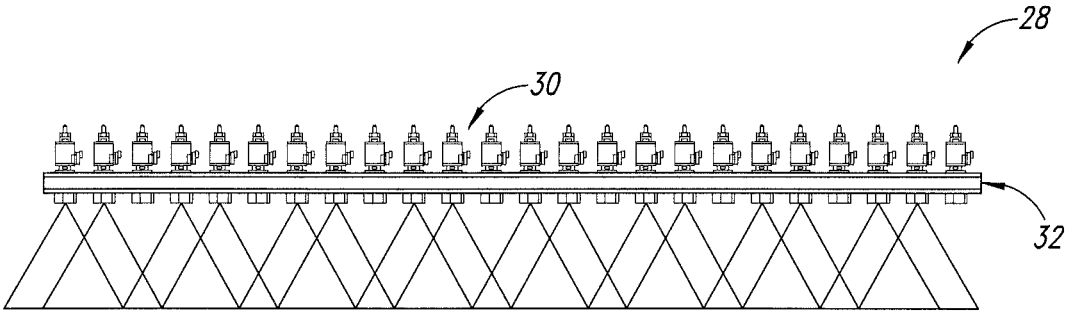
FIG. 6 is a front view of the first embodiment of a spray assembly of the invention that is illustrated in FIG. 2, showing its use in applying a second spray pattern.
Figure 7:
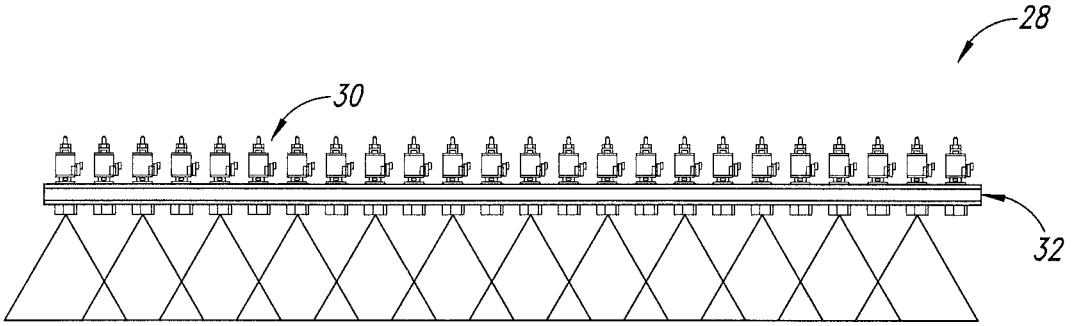
FIG. 7 is a front view of the first embodiment of a spray assembly of the invention that is illustrated in FIG. 2, showing its use in applying a third spray pattern.
Figure 8:
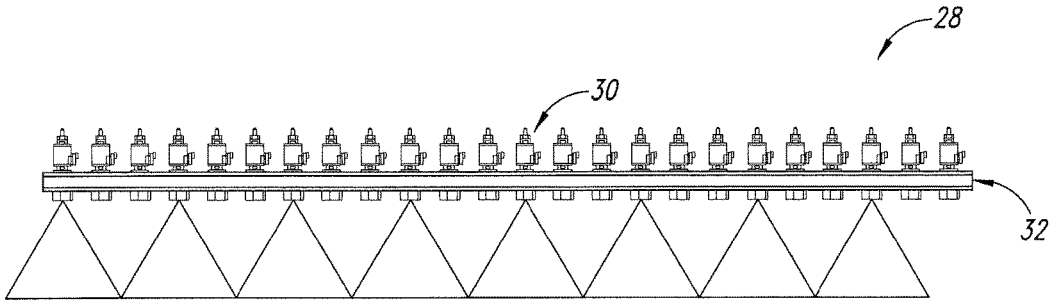
FIG. 8 is a front view of the first embodiment of a spray assembly of the invention that is illustrated in FIG. 2, showing its use in applying a fourth spray pattern.

Since input module 34 of the controller is operatively connected to each nozzle assembly 30, the nozzle assemblies can be operated to produce various spray configurations. Thus, FIG. 5 illustrates the simultaneous operation of all of the nozzle assemblies in spray assembly 28 in order to produce a triple-overlay spray configuration. FIG. 6 shows the simultaneous operation of pairs of nozzle assemblies with a single nozzle assembly between each pair turned off to produce spray coverage similar to that obtained by the operation illustrated in FIG. 5. In the example of FIG. 6, the controller generates a similar spray pattern as that of the operation of the FIG. 5 configuration by increasing the fluid pressure through ⅔ of the nozzle assemblies (i.e. with ⅓ of the nozzle assemblies turned off). Similarly, FIG. 7 illustrates the simultaneous operation of alternating nozzle assemblies. In this configuration, the controller may create the same fluid flow rate as that obtained by the operating configuration of FIG. 5 with only half the nozzle assemblies of the configuration of FIG. 5 being operated, by increasing the fluid pressure through the operating nozzle assemblies. FIG. 8 illustrates the simultaneous operation of ⅓ of the nozzle assemblies, with a pair of non-operating nozzle assemblies adjacent to each operating nozzle assembly. In this configuration, the controller may generate the same fluid flow rate as that obtained by the operating configuration of FIG. 5 with only ⅓ of the nozzle assemblies of the configuration of FIG. 5 being operated, by increasing the fluid pressure through the operating nozzle assemblies.

Figure 9:
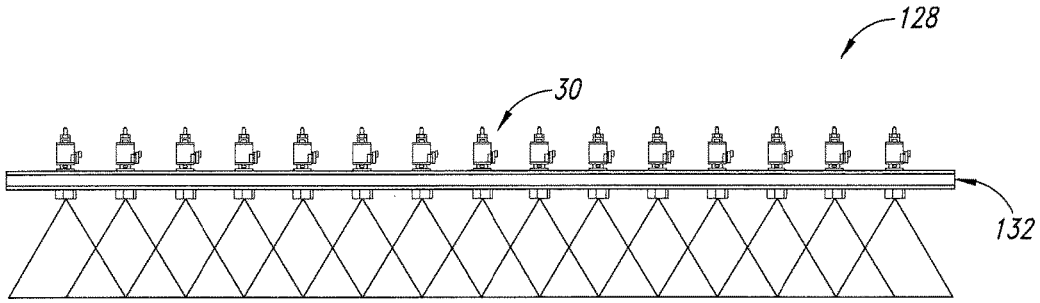
FIG. 9 is a front view of a second embodiment of a spray assembly of the invention, showing its use in applying a fifth spray pattern.
Figure 10:
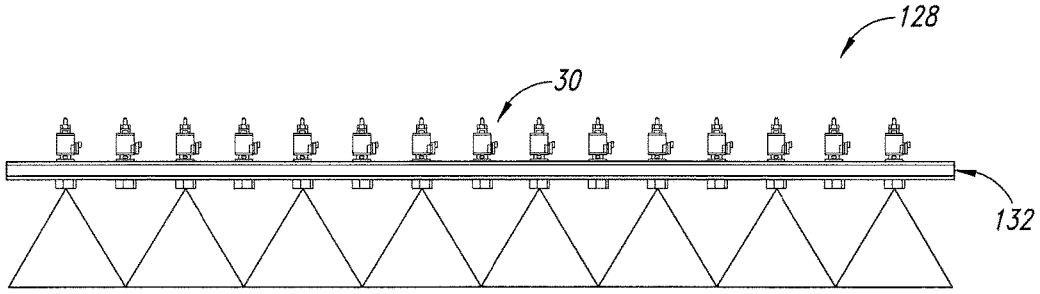
FIG. 10 is a front view of a second embodiment of a spray assembly of the invention, showing its use in applying a sixth spray pattern.

FIGS. 9 and 10 illustrate an alternative spray assembly 128 which has fifteen nozzle assemblies 30 spaced along support beam 132. FIG. 9 illustrates the spray pattern that may be obtained when all of the nozzle assemblies are operated simultaneously, and FIG. 10 illustrates that which may be obtained when only half the nozzle assemblies are simultaneously operated, with a non-operating nozzle assembly adjacent to each operating nozzle assembly.

The invention provides for direct electrical actuation of the valves associated with spray assemblies for working machines. By avoiding pilot-control valves and the fluid piping and components associated with such conventional systems, the invention greatly simplifies the design of the spray assembly and gives the designer the flexibility to locate the control components for the spray assembly closer to the valves, thereby keeping the wiring between the controller and the valves shorter.

Although this description contains many specifics, these should not be construed as limiting the scope of the invention but as merely providing illustrations of some of the presently preferred embodiments thereof, as well as the best mode contemplated by the inventor of carrying out the invention. The invention, as described and claimed herein, is susceptible to various modifications and adaptations as would be appreciated by those having ordinary skill in the art to which the invention relates.

What is claimed is:

1. A spray assembly for a working machine that includes a fluid storage tank and is adapted for operation on a roadway, said spray assembly being in fluid communication with the fluid storage tank and further comprising:

(a) a plurality of nozzle assemblies, each of which comprises a direct acting valve;

(b) a controller that is operatively connected to each of the direct acting valves for controlling the opening and closing thereof;

(c) a selector that is operatively connected to the controller, which selector may be employed by an operator of the working machine to selectively operate one or more of the direct acting valves in order to provide a desired spray pattern of fluid from the fluid storage tank onto the roadway;

wherein each of the direct acting valves is a direct acting poppet valve that is enabled by a linear solenoid;

(d) which includes a support beam that is attached to a frame of the working machine;

(e) which includes a power source for the controller;

(f) wherein each of the nozzle assemblies:

(i) is mounted on the support beam;

(ii) includes a solenoid switch assembly and a valve assembly;

(g) wherein the controller comprises:

(i) a spray control;

(ii) an input module that is operatively connected to the solenoid switch assembly of each nozzle assembly and to the spray control, said input module being adapted to determine if the valve assembly of each nozzle assembly is open or closed;

(iii) an output module that is operatively connected to the spray assembly and to the power source, said output module being adapted to energize the solenoid switch assembly of each nozzle assembly in the spray assembly.

2. The spray assembly of claim 1, wherein the controller is adapted to employ pulse- width modulation current control to reduce the current required to hold the direct acting poppet valves open.

3. The spray assembly of claim 1, wherein the input module is operatively connected to one or more sensors for measuring operating parameters of the spray assembly.

4. The spray assembly of claim 1, wherein each valve assembly comprises:

(a) a nozzle housing which includes a poppet bushing;

(b) a valve housing that is in fluid communication with the fluid storage tank of the working machine and the nozzle housing;

(c) a poppet shaft having an upper end and a lower end;

(d) a poppet which is attached to the lower end of the poppet shaft;

(e) a plunger which is attached to the upper end of the poppet shaft;

(f) a return spring surrounding the poppet shaft and adapted to hold the poppet in abutment with the poppet bushing in the nozzle housing when the solenoid switch assembly is not energized.

5. The spray assembly of claim 4, wherein each solenoid switch assembly comprises:

(a) a switch conductor that is electrically connected to the power source;

(b) a switch pin insulator that is operatively connected to the switch conductor;

(c) a switch pin that is electrically connected to the switch conductor;

(d) a coil that surrounds the plunger of the valve assembly associated therewith, said coil being electrically connected to the switch pin; wherein the controller is adapted to energize the solenoid switch assembly to cause electricity from the power source to flow through the switch conductor and the switch pin to energize the coil, thereby creating a magnetic field which causes the plunger to be drawn upwardly so that the poppet is not in abutment with the poppet housing.

6. The spray assembly of claim 5, wherein each valve assembly includes an inlet port in the valve housing that is in fluid communication with the fluid storage tank of the working machine.

7. The spray assembly of claim 5, wherein each valve assembly includes a travel stop that is located so as to be engaged by an upper end of the plunger when the controller causes electricity to energize the coil to generate a magnetic field to draw the plunger upwardly.

8. The spray assembly of claim 5, wherein each valve assembly includes a shaft seal that prevents fluid from leaking upwardly around the poppet shaft when the plunger is drawn upwardly so that the poppet is not in abutment with the poppet housing.

* * * * *